US009845927B2

(12) United States Patent
Sorensen et al.

(10) Patent No.: US 9,845,927 B2
(45) Date of Patent: Dec. 19, 2017

(54) MODULAR LED LIGHTING SYSTEM

(71) Applicant: Litetronics International, Inc., Harvey, IL (US)

(72) Inventors: Robert Sorensen, Harvey, IL (US); Raghu Rao, Romeoville, IL (US)

(73) Assignee: Litetronics International, Inc., Bedford Park, IL (US)

( * ) Notice: Subject to any disclaimer, the term of this patent is extended or adjusted under 35 U.S.C. 154(b) by 85 days.

(21) Appl. No.: 14/996,193

(22) Filed: Jan. 14, 2016

(65) Prior Publication Data

US 2017/0205036 A1 Jul. 20, 2017

(51) Int. Cl.

| | |
|---|---|
| ***F21V 15/00*** | (2015.01) |
| ***F21S 8/02*** | (2006.01) |
| ***F21K 99/00*** | (2016.01) |
| ***F21V 15/01*** | (2006.01) |
| ***F21V 17/10*** | (2006.01) |

(52) U.S. Cl.

CPC ..... *F21S 8/026* (2013.01); *F21K 9/30* (2013.01); *F21V 15/01* (2013.01); *F21V 17/105* (2013.01)

(58) Field of Classification Search

CPC .. F21S 8/026; F21K 9/30; F21V 15/01; F21V 17/105

See application file for complete search history.

(56) References Cited

U.S. PATENT DOCUMENTS

2011/0002120 A1* 1/2011 Song ..... F21S 2/005 362/249.02
2012/0051050 A1* 3/2012 Lee ..... F21S 2/005 362/235
2012/0243227 A1* 9/2012 Shimizu ..... F21S 8/04 362/249.01

* cited by examiner

*Primary Examiner* — Thomas M Sember
(74) *Attorney, Agent, or Firm* — Witters & Associates; Steve Witters

(57) ABSTRACT

A modular LED lighting system is presently disclosed, the system comprises at least one LED lamp housing configured to house and hold at least one longitudinally extending LED lamp or an array of LEDs. The LED lamp housing comprises two substantially parallel longitudinally extending sidewalls and two substantially parallel end walls, each end wall extends from edges of the sidewalls to form an LED lamp housing with a rectangular lower light opening. Each of the sidewalls are configured to abut with a sidewall of an adjacent LED lamp housing and each of the end walls are configured to abut with an end wall of an adjacent LED lamp housing, in the modular LED lighting system. Each of the at least one LED lamp housings in the modular LED lighting system are configured to adjoin with an adjacent LED lamp housing.

18 Claims, 15 Drawing Sheets

MODULAR LED LIGHTING SYSTEM

FIELD OF THE DISCLOSURE

This invention generally relates to lighting systems, and more particularly, to a modular LED lighting system.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Fluorescent light fixtures, such as strip and troffer light fixtures, have typically been installed to provide general lighting of large indoor spaces. For example, fluorescent light fixtures may include troffers that may be stem or pendant mounted or suspended from a ceiling.

Typically, such fluorescent fixtures may include a channel in the form of an inverted troffer, with the channel being attached to, or suspended from, a structure. Lamp holders or sockets are typically attached to the channel or troffer. A ballast is attached within the troffer and wiring attaches the ballast to the lamp holders. Power is supplied to the ballast by wiring brought into the troffer through the top or end of the channel. A ballast cover is used to cover the ballast and wiring. Linear fluorescent lamps are then placed in the lamp holders for operation of the fixture. The lamps may be left bare or covered, with a lens for example, for providing light to the space below. Because of their low cost and utilitarian use, fluorescent strip light fixtures are currently installed in abundance. For example, typical uses include warehouses, retail stores, such as grocery, drug, and department stores, where the fixtures are commonly mounted in continuous rows.

Since the introduction of the fluorescent lamp at the 1939 World Fair, fluorescent lighting technology has greatly advanced. For example, over the years, lamp and ballast manufacturers have developed fluorescent lamp-ballast systems with improved efficiencies. More recently, light emitting diode (LED) lamps have been developed. An LED lamp is a solid-state lamp that uses LEDs as the source of light. An LED may comprise a conventional semiconductor light emitting diode or an organic or polymeric light emitting diode. LED lamps may have one or more advantages over fluorescent lamps, for example, LED lamps do not contain mercury, they may turn on more instantaneously, they may have a longer service life, and they may have a greater efficiency.

It may be desired to provide advantages of LEDs to lighting systems. However, it may be difficult to provide an LED lighting system that may be tailored to a desired application. Thus, there is a need for modular LED lighting systems, kits, and methods that may provide a desired arrangement of LED lights in an LED lighting system.

SUMMARY

In at least one aspect of the present disclosure, a modular LED lighting system is disclosed. The modular LED lighting system comprises at least one LED lamp housing configured to house and hold at least one longitudinally extending LED lamp or an array of LEDs mounted inside the lamp housing and electrically connect the at least one longitudinally extending LED lamp or the array of LEDs to a power source. The LED lamp housing comprises two substantially parallel longitudinally extending sidewalls, each sidewall being at least as long as the at least one longitudinally extending LED lamp or the array of LEDs. Two substantially parallel end walls extend from edges of the sidewalls to form an LED lamp housing with a rectangular bottom light opening. Each of the sidewalls and each of the end walls comprise a flange extending outwardly from a perimeter of the light opening, the flange being configured for mounting the modular LED lamp on a ceiling suspension grid. An abutting surface extends upwardly from the flange and is configured for abutting each of the at least one LED lamp housings with an adjacent LED lamp housing, in the modular LED lighting system.

In at least one other aspect of the present disclosure, a modular LED lighting system is disclosed. The modular LED lighting system comprises at least one LED lamp housing, wherein the at least one LED lamp housing is configured to house and hold at least one longitudinally extending LED lamp or an array of LEDs mounted inside the lamp housing and electrically connect the at least one longitudinally extending LED lamp or the array of LEDs to a power source. The LED lamp housing comprises two substantially parallel longitudinally extending sidewalls, each sidewall being at least as long as the at least one longitudinally extending LED lamp or the array of LEDs. Two substantially parallel end walls extend from edges of the sidewalls and form an LED lamp housing with a rectangular lower light opening. Each of the sidewalls are configured to abut with a sidewall of an adjacent LED lamp housing in the modular LED lighting system. Each of the end walls are configured to abut with an end wall of an adjacent LED lamp housing in the modular LED lighting system. Each of the at least one LED lamp housings in the modular LED lighting system is configured to adjoin with an adjacent LED lamp housing.

BRIEF DESCRIPTIONS OF THE DRAWINGS

The following figures, which are idealized, are not to scale and are intended to be merely illustrative of aspects of the present disclosure and non-limiting. In the drawings, like elements may be depicted by like reference numerals. The drawings are briefly described as follows.

Figure 5A:
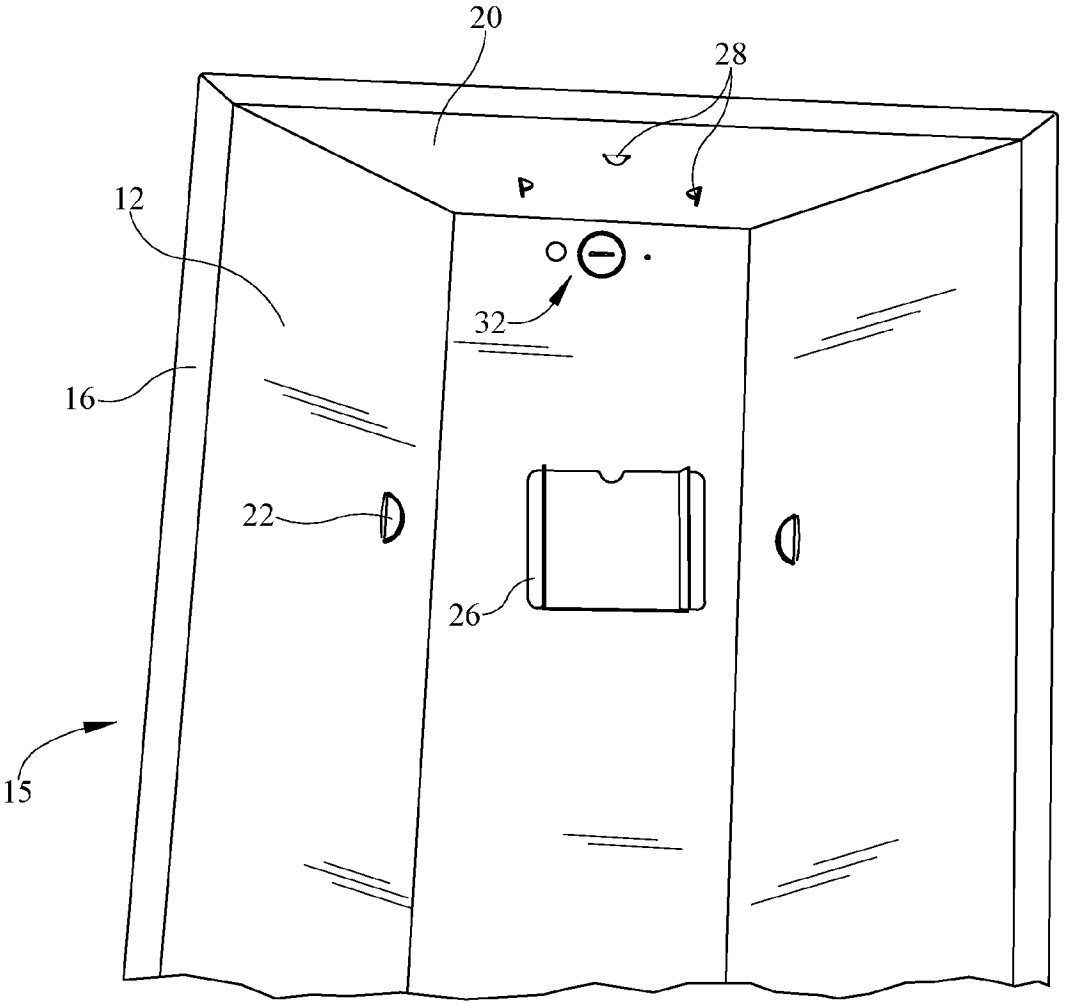
Figure 5B:
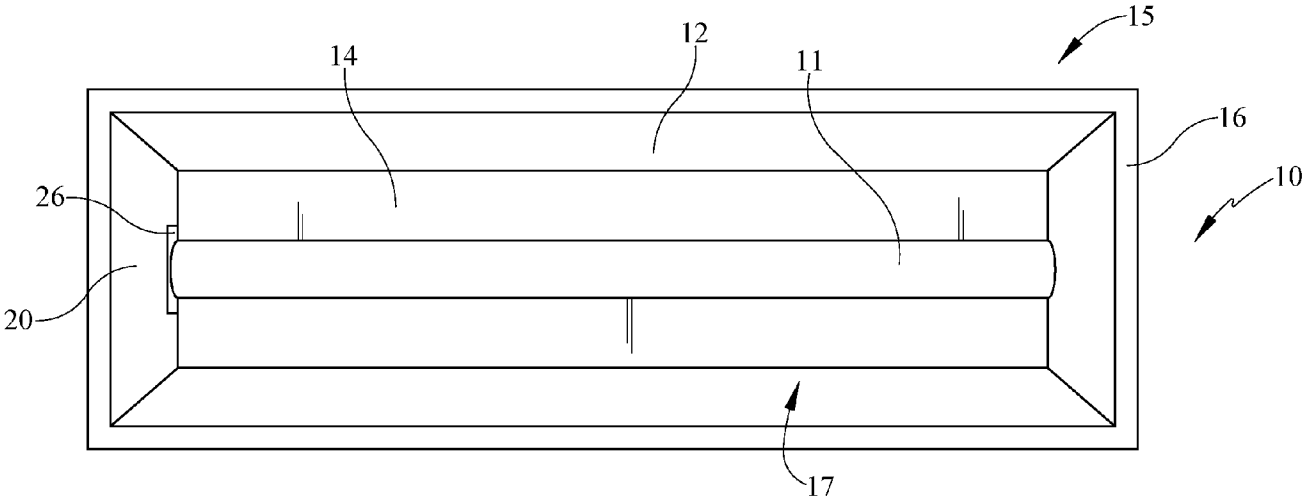
Figure 5C:
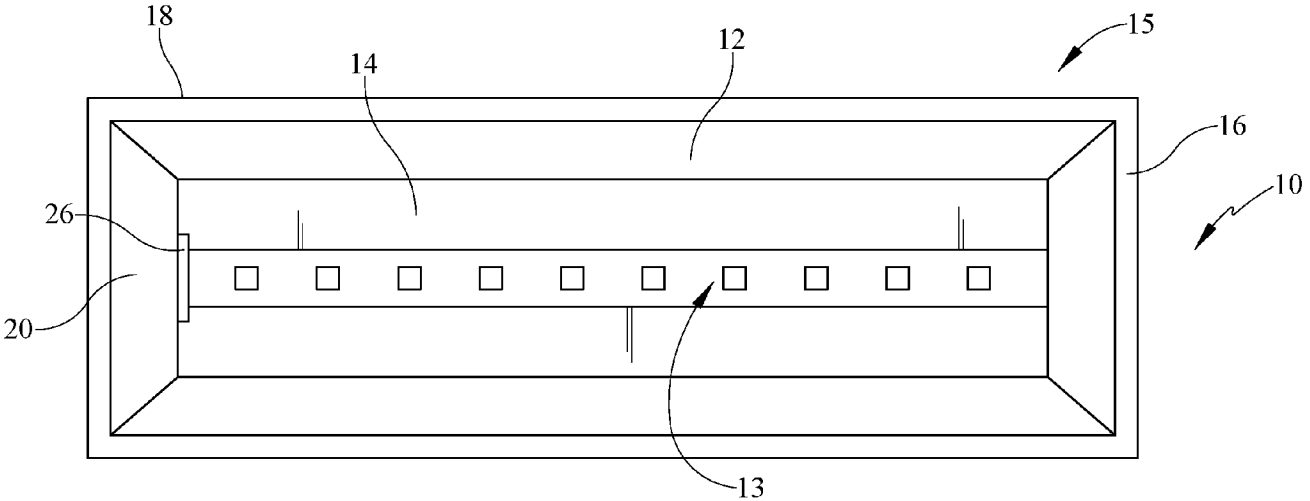
Figure 6A:
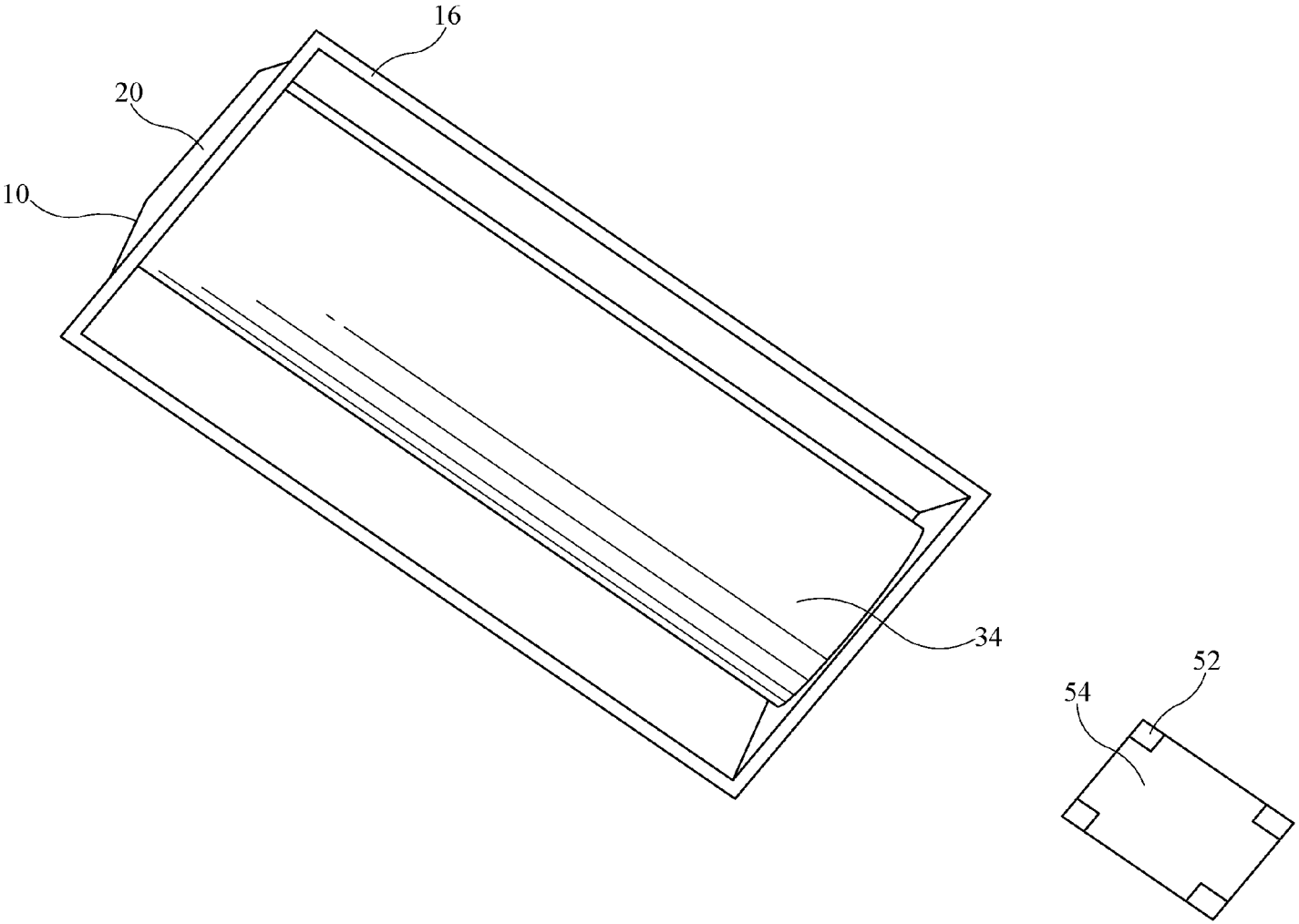
Figure 6B:
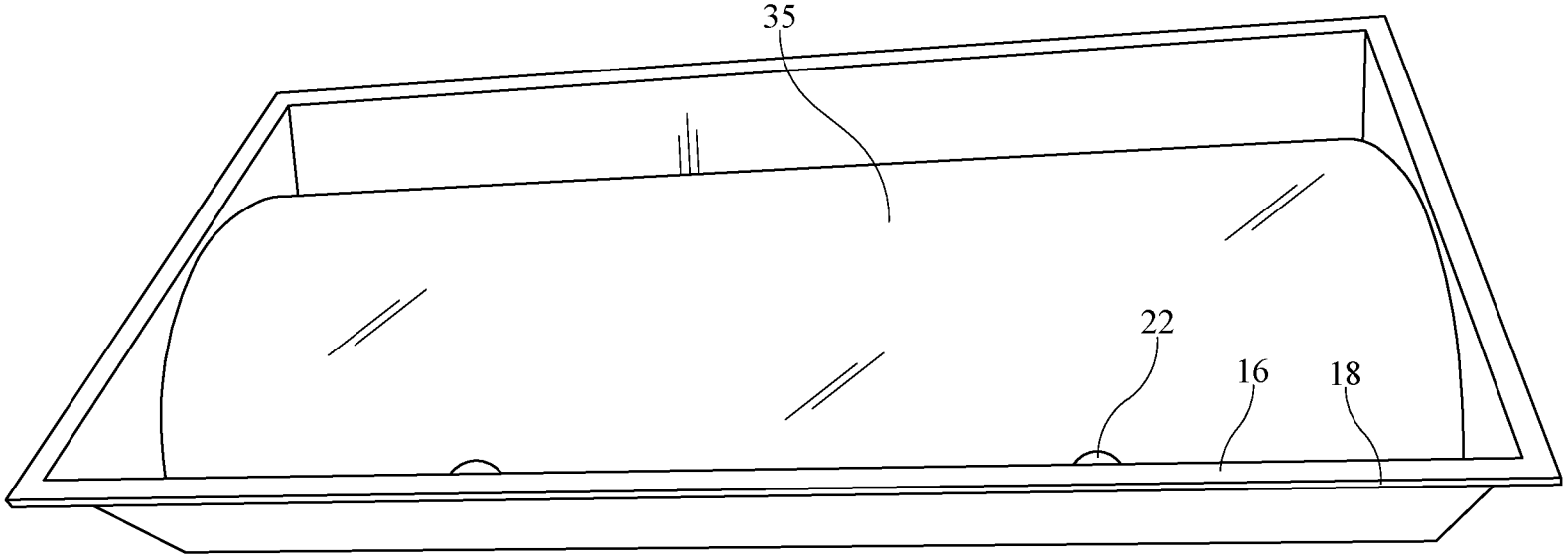
Figure 6C:
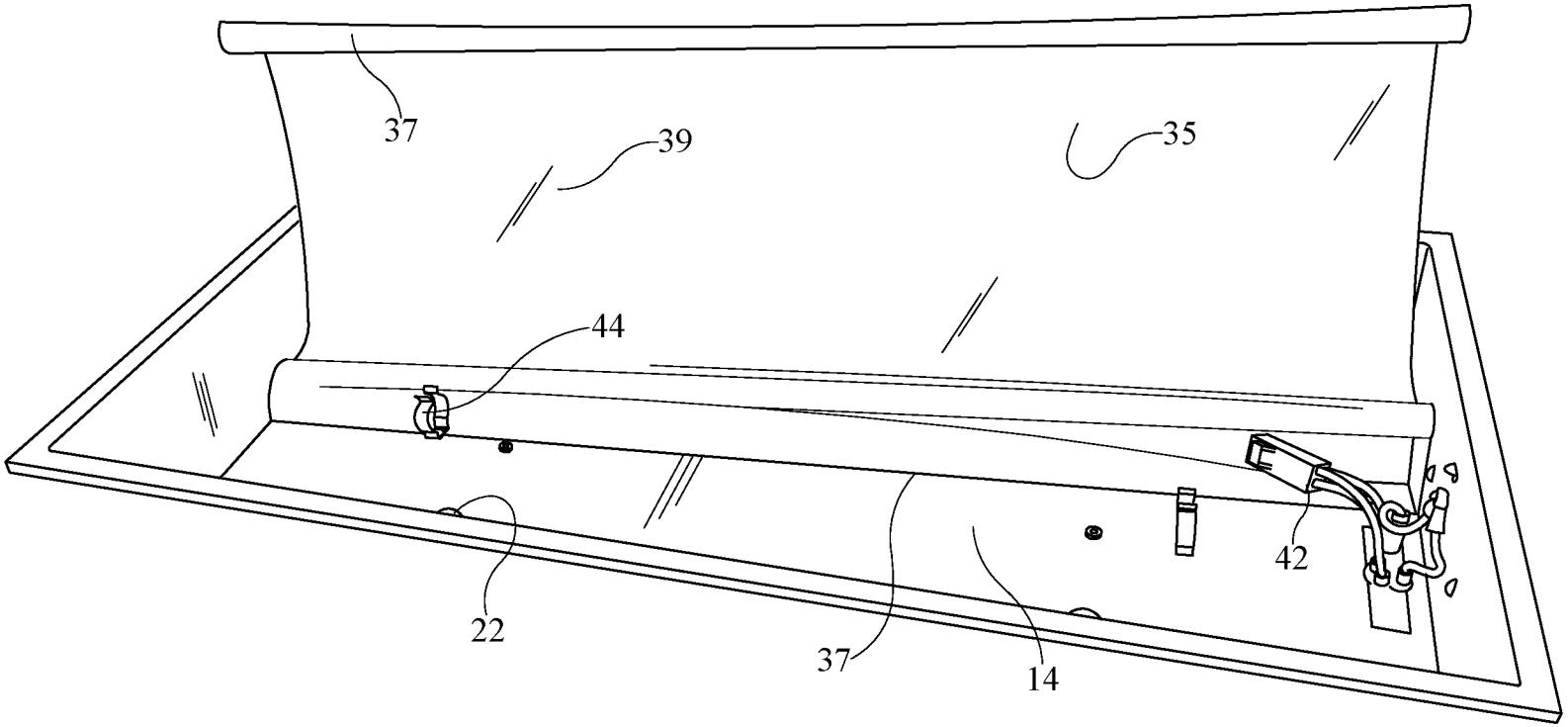
Figure 7:
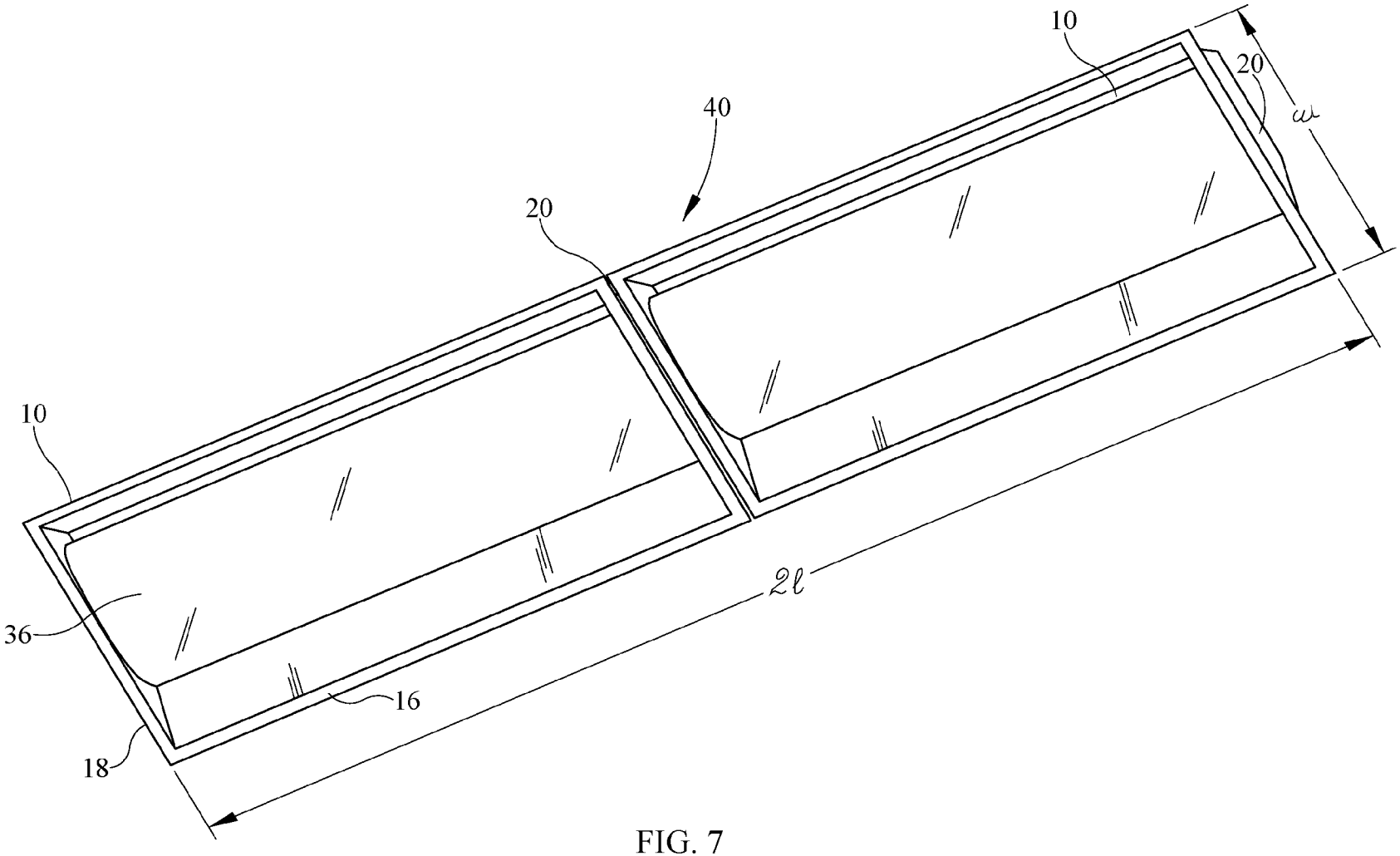
Figure 8:
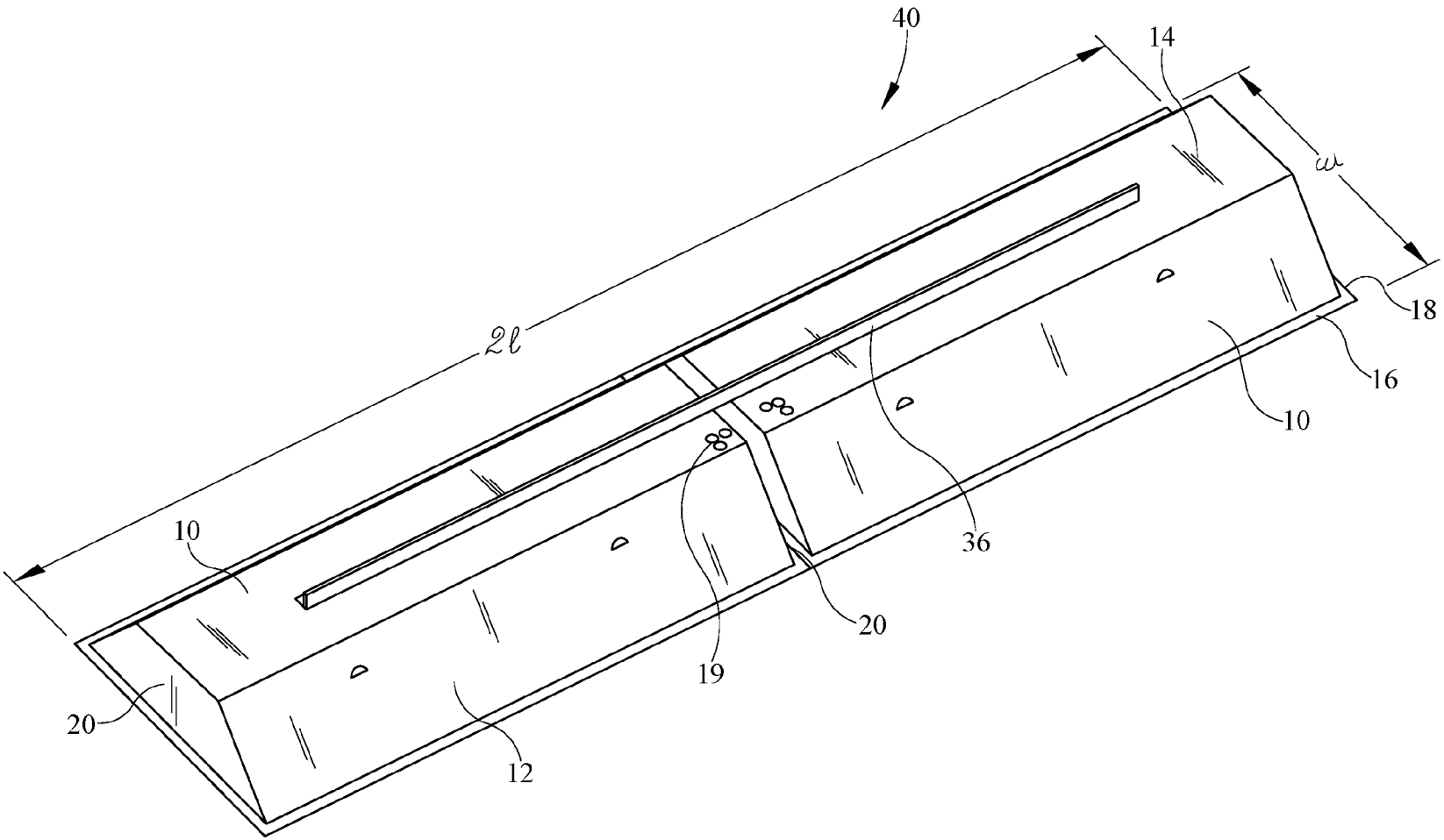
Figure 9:
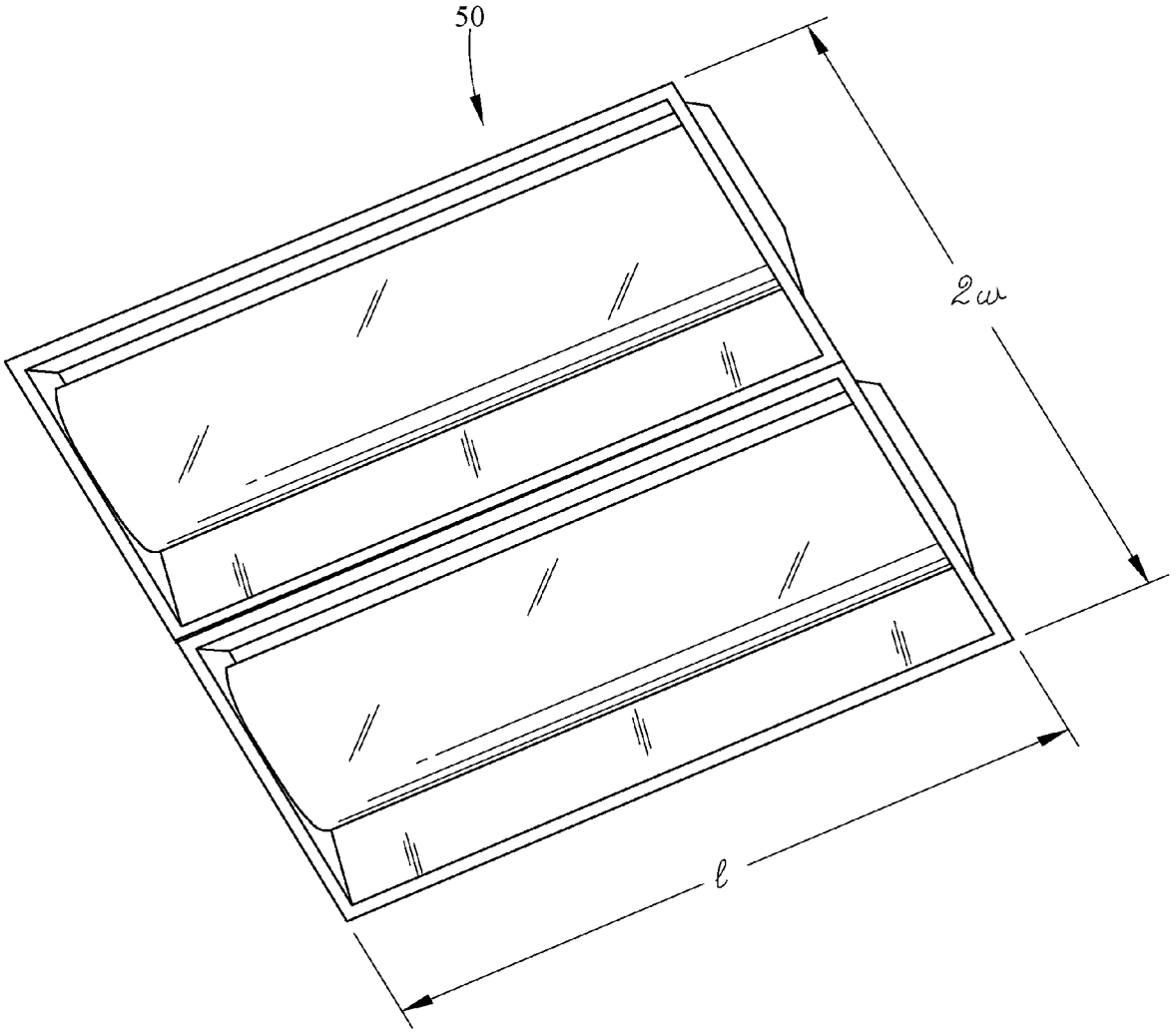
Figure 10:
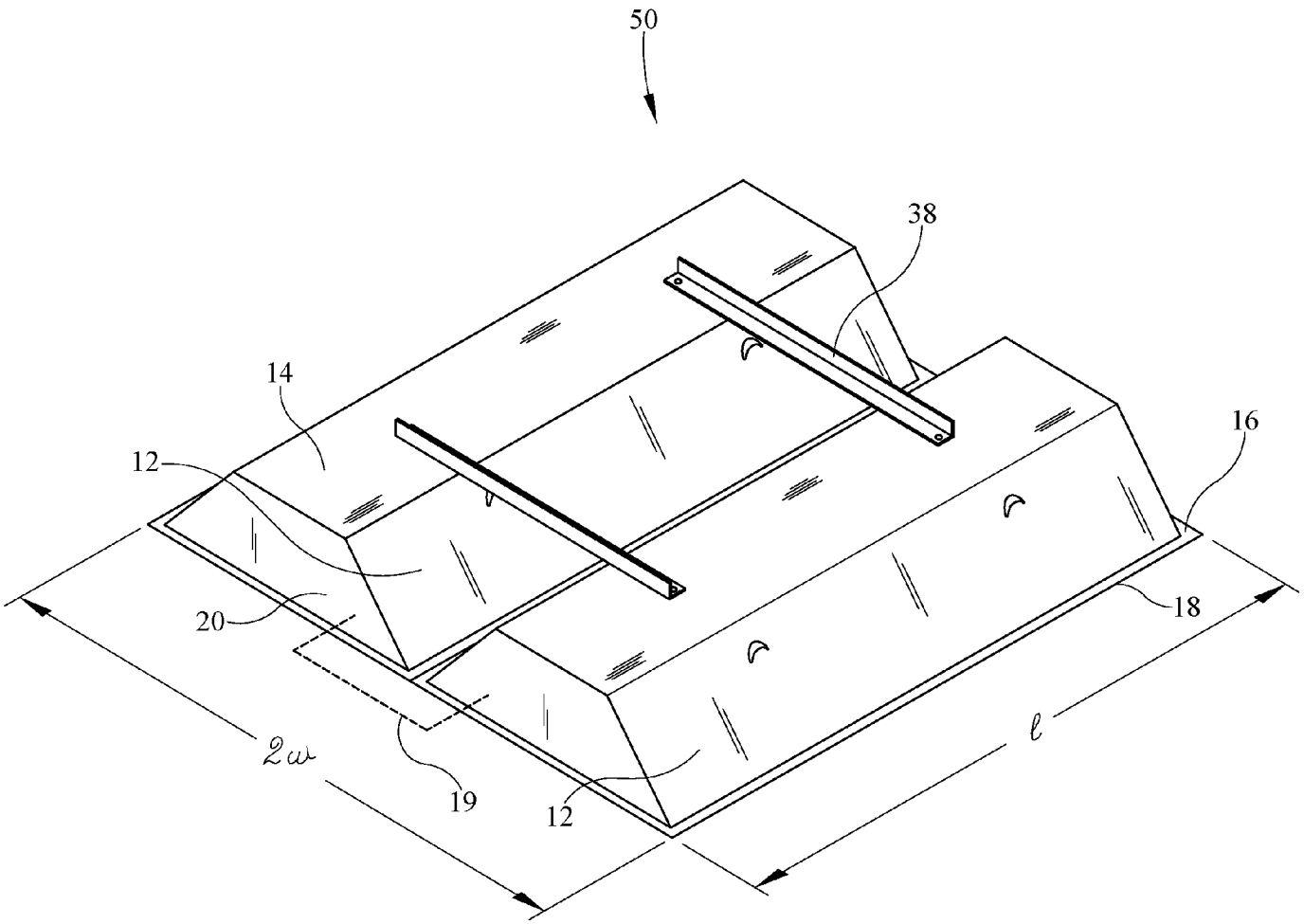
Figure 11:
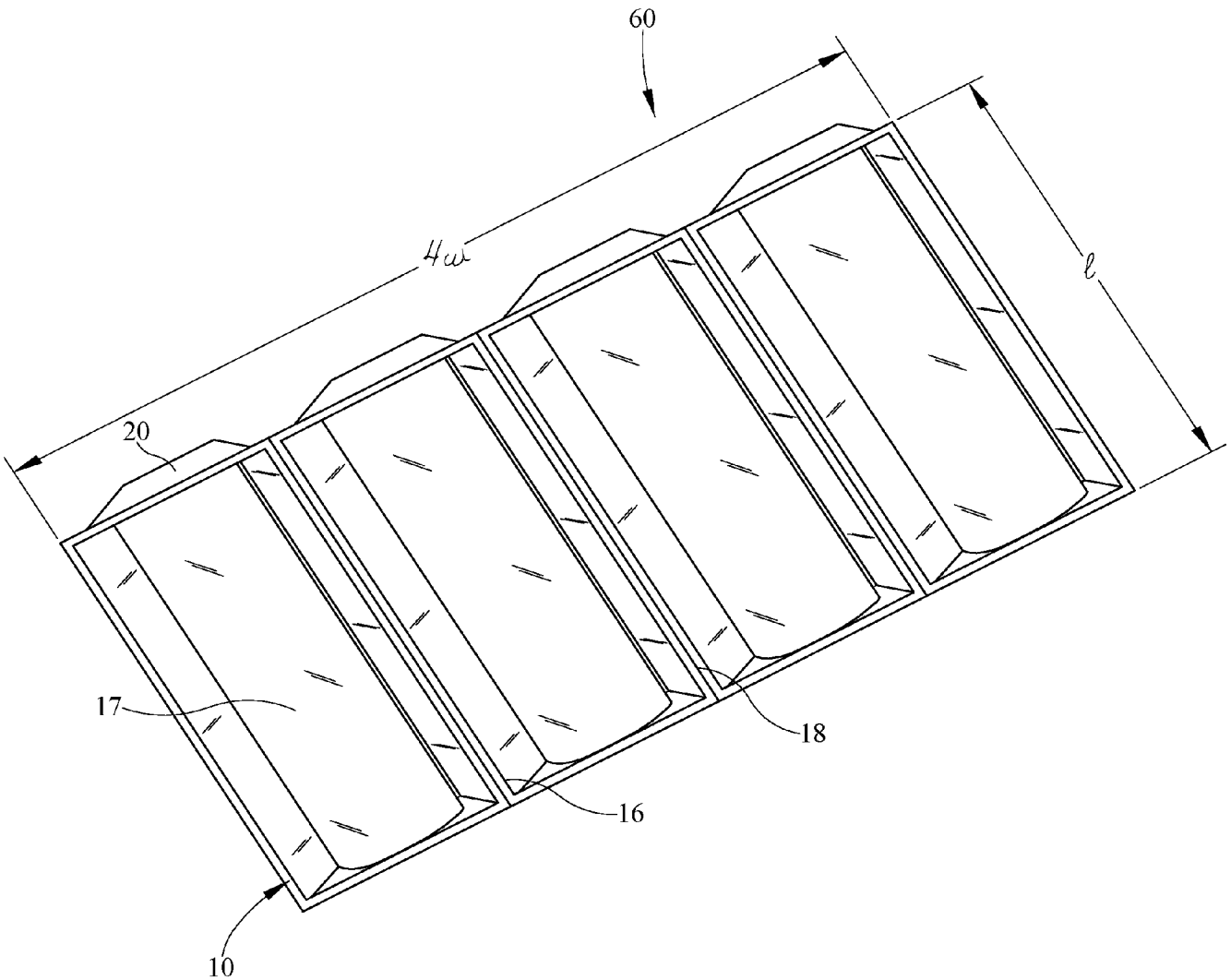
Figure 12:
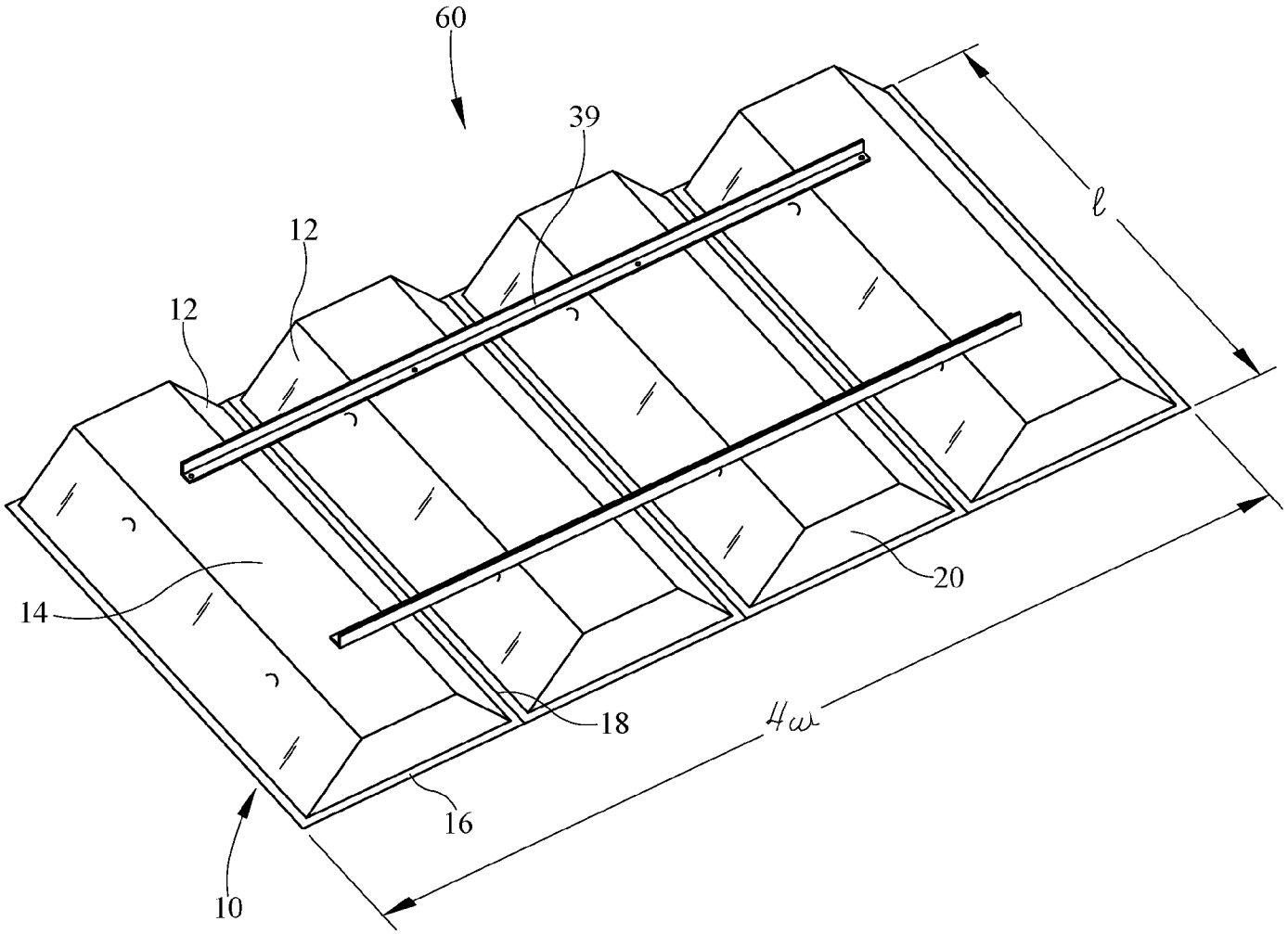

FIG. 5*a* is a bottom view of a portion of a lamp housing of the modular LED lighting system of the present disclosure showing a removed electrical cover;

FIG. 5*b* is a bottom view of the LED lamp housing shown in FIG. 5*a* holding a longitudinally extending LED lamp;

FIG. 5*c* is a bottom view of the LED lamp housing shown in FIG. 5*a* holding an array of LEDs;

FIG. 6*a* is a lower perspective view of a LED lamp housing having a mechanically mounted lens;

FIGS. 6*b* and 6*c* show a mechanically mountable lens;

FIG. 7 is lower perspective view of the modular LED lighting system of the present disclosure having adjacent LED lamp housings with abutted end walls;

FIG. 8 is an upper perspective view of the modular LED lighting system of FIG. 7 showing an adjoining bar;

FIG. 9 is lower perspective view of the modular LED lighting system of the present disclosure having adjacent LED lamp housings with abutted sidewalls;

FIG. 10 is an upper perspective view of the modular LED lighting system of FIG. 9 showing adjoining bars;

FIG. 11 is lower perspective view of the modular LED lighting system of the present disclosure having a plurality LED lamp housings, each having at least one sidewall abutted with a sidewall of an adjacent LED lamp housing; and FIG. 12 is an upper perspective view of the modular LED lighting system of FIG. 11 showing adjoining bars.

DETAILED DESCRIPTION

Reference will now be made in detail to the present exemplary embodiments and aspects of the present invention, examples of which are illustrated in the accompanying figures. The same reference numbers may be used in the figures to refer to the same or like parts. The presently disclosed embodiments, aspects, and features of the present invention are not to limit the presently claimed invention as other and different embodiments, aspects, and features will become apparent to one skilled in the art upon reading the present disclosure.

FIGS. 1-4 show a top, upper perspective, side perspective, and bottom view, respectively, of an LED lamp housing 10. Lamp housing 10 is configured to be a component part of the modular LED lighting system of the present disclosure. For example, a modular LED lighting system may comprise at least one LED lamp housing 10. LED lamp housing 10 may be configured to house and hold at least one longitudinally extending LED lamp or an array of LEDs. LED lamp housing 10 may be configured to electrically connect the at least one longitudinally extending LED lamp or the array of LEDs to a power source such as a power source leading from a structure or another LED lamp housing in the modular LED lighting system.

LED lamp housing 10 may comprise two substantially parallel longitudinally extending sidewalls 12, each longitudinally extending sidewall 12 is at least as long as the at least one longitudinally extending LED lamp or the array of LEDs to be mounted in LED lamp housing 10. For example, sidewalls 12 may have a length l, greater than a length of the at least one longitudinally extending LED lamp or the array of LEDs to be mounted in LED lamp housing 10. Sidewalls 12 may have tabs 22 extending inwardly. Tabs 22 may be configured and disposed for mechanically mounting a lens in, on, or about a light opening 17, shown in FIG. 4.

LED lamp housing 10 may comprise two substantially parallel end walls 20, wherein each end wall 20 may extend from edges of longitudinally extending sidewalls 12 and form LED lamp housing 10 with a rectangular bottom light opening 17. End walls 20 may have a width w and a configuration for holding one or more longitudinally extending LED lamps or the arrays of LEDs. For example, lamp housing 10 may be configured to hold or house a plurality of LED lamps or arrays of LEDs in a parallel configuration, and for providing a desired configuration of light opening 17. For example, light opening 17 may be square. In the embodiment of end walls 20 shown in FIGS. 1-4, end walls 20 have a trapezoidal configuration. However, it is to be understood that end walls 20 may have a variety of configurations for enabling housing 10 to hold one or more longitudinally extending LED lamps or the arrays of LEDs and provide a desired configuration of light opening 17.

A flange 16 may extend outwardly from each of the longitudinally extending sidewalls 12 and end walls 20 and around a perimeter of the light opening 17. Flange 16 may be configured and disposed for mounting a modular LED lamp system comprising one or more LED lamp housing 10 on a ceiling suspension grid. In at least one embodiment of the present disclosure, flange 16 extends completely around light opening 17 and is void of interruptions. However, it is to be understood that flange 16 may not be required to extend outwardly from the four lower corners of LED lamp housing 10.

An abutting surface 18 may extend upwardly from flange 16 and may be configured for abutting each of the at least one LED lamp housings 10, in the modular LED lighting system of the present disclosure, with an adjacent LED lamp housing 10. For example, an embodiment of the modular LED lighting system of the present disclosure may comprise at least two LED lamp housings 10 adjoined to one another, each LED lamp housing 10 may have a sidewall 12 abutted with a sidewall 12 of an adjacent LED lamp housing 10 or an end wall 20 abutted with an end wall 20 of an adjacent LED lamp housing 10. The abutted surfaces 18, of the sidewalls 12 or end walls 20 of the adjoined LED lamp housings 10, may be entirely, or substantially entirely, in contact with one another upon adjoining.

The modular LED lighting system of the present disclosure may comprise one or more LED lamp housings with a top wall 14 extending from top edges of sidewalls 12 and top edges of the end walls 20. Top wall 14 may enclose a top of LED lamp housing 10 and light opening 17 may be an open bottom of LED lamp housing 10. Fastening sites 24 may be provided in top wall 14. Fastening sites 24 may be configured and disposed for adjoining two or more lamp housings 10 together. For example, an adjoining bar may be fastened at one or more fastening sites 24.

FIG. 5*a* shows a bottom view of a portion of a LED lamp housing 15 of the modular LED lighting system of the present disclosure having a removed electrical cover 26. Electrical lead sites 32 may be configured and disposed for leading wires into LED lamp housing 15 and supplying power to at least one longitudinally extending LED lamp or an array of LEDs housed in LED lamp housing 15. For example, one or more electrical wires may lead into LED lamp housing 15 from another LED lamp housing 15, in the modular LED lighting system, or from electrical lines extending from a power source.

Figure 1:
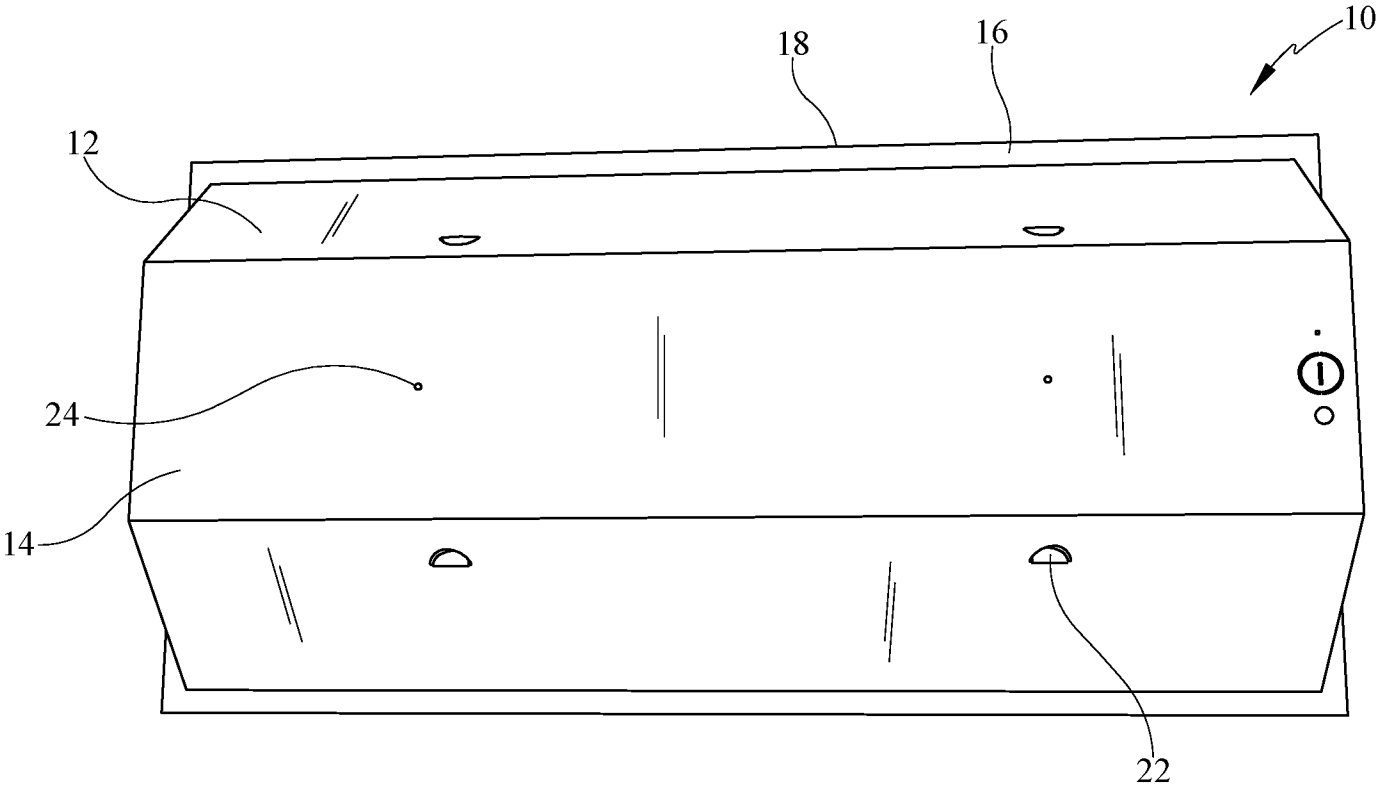
FIG. 1 is top view of an LED lamp housing of the modular LED lighting system of the present disclosure.
Figure 2:
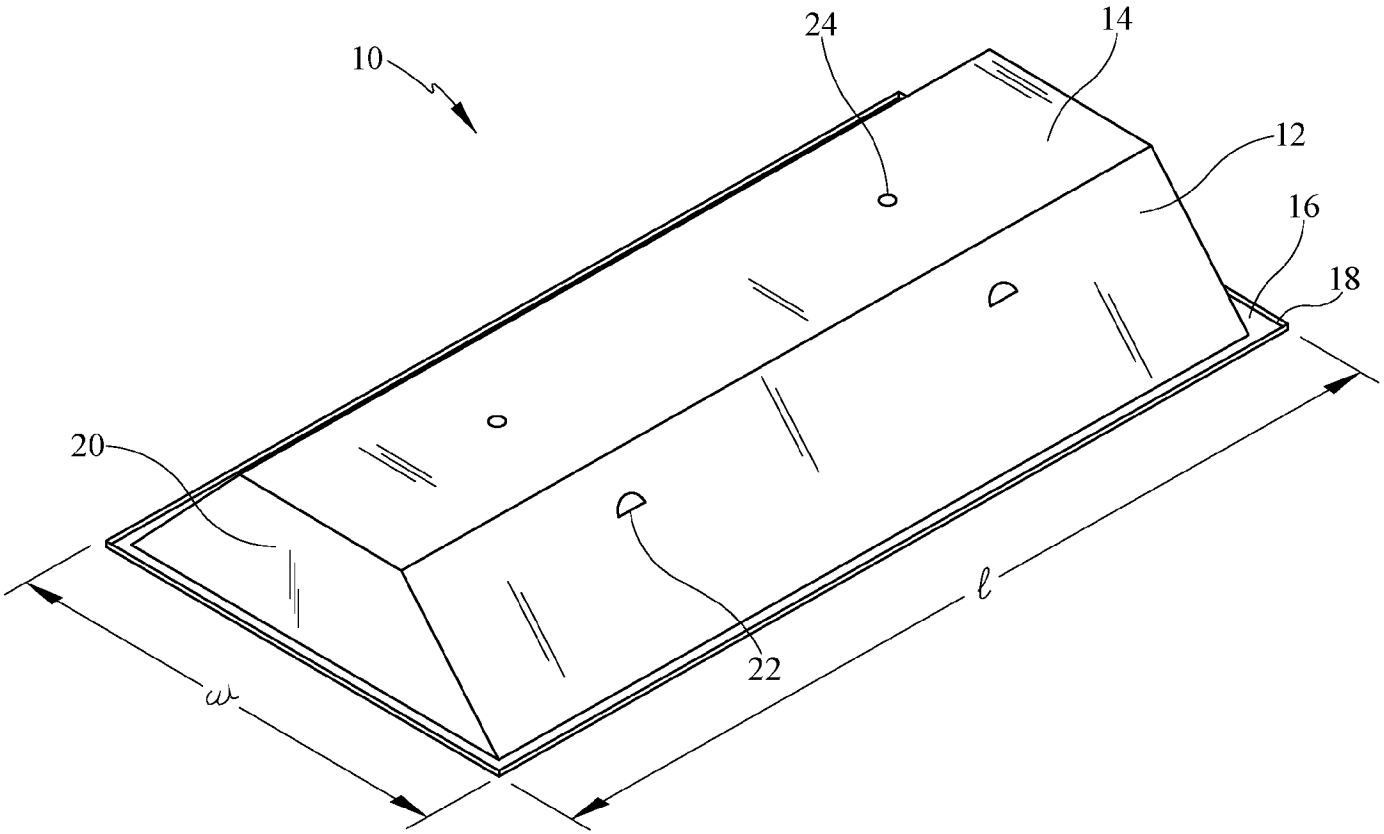
FIG. 2 is an upper perspective view of the LED lamp housing shown in FIG. 1.
Figure 3:
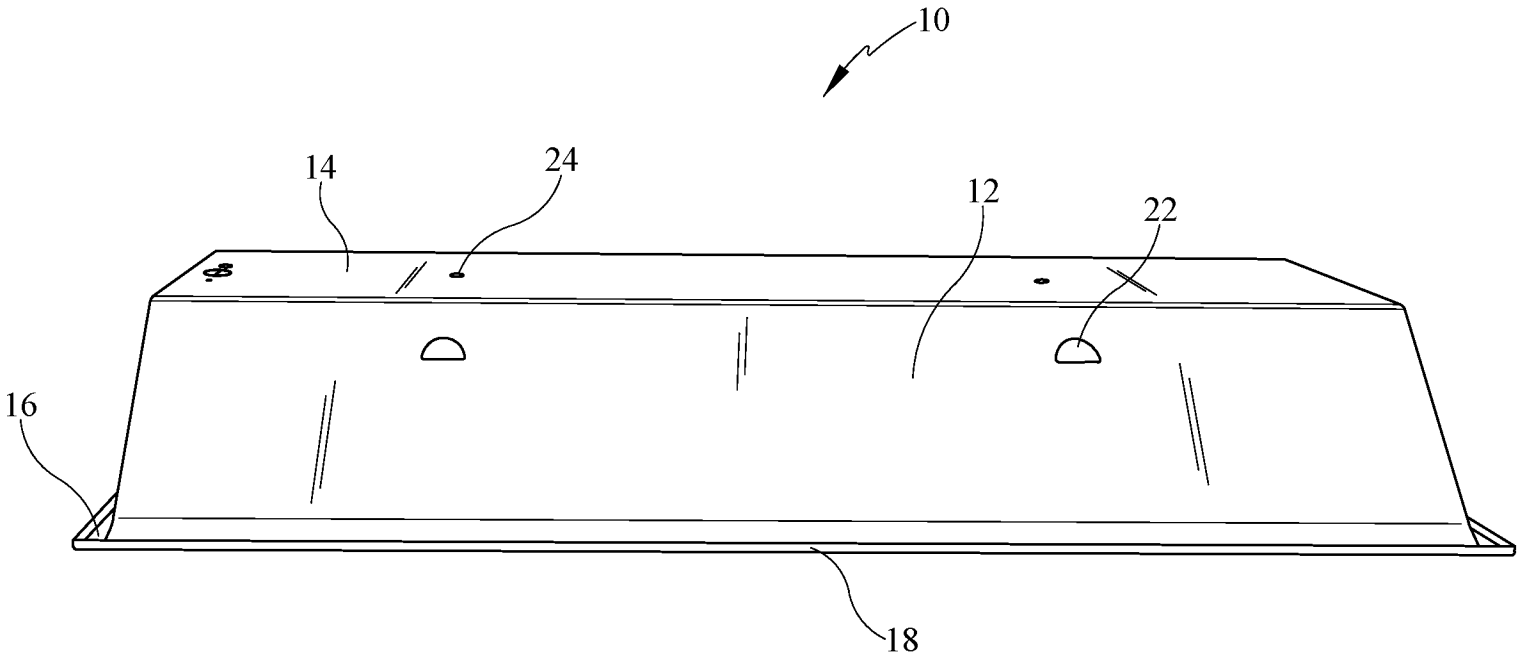
FIG. 3 is side perspective view of the LED lamp housing shown in FIG. 1.
Figure 4:
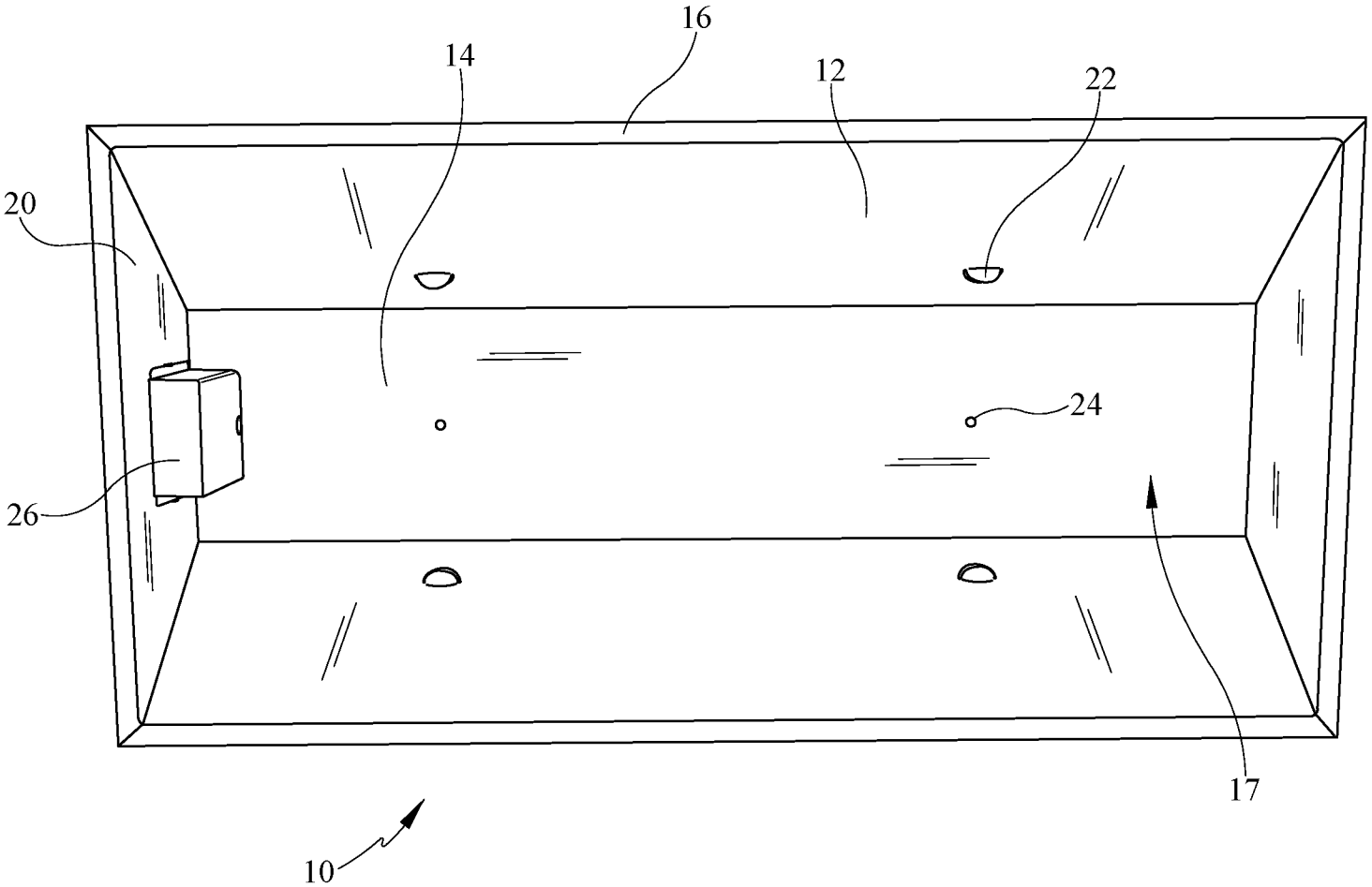
FIG. 4 is a bottom view of the LED lamp housing shown in FIG. 1.

Electrical cover mounting tabs 28 may extend into LED lamp housing 15 and may be configured and disposed for mounting electrical cover 26 onto an inner side of a sidewall 20, as shown in FIG. 4. Upon mounting electrical cover 26 onto an inner side of a sidewall 20, an electrical junction between wires, wires leading into LED lamp housing 15 through electrical lead sites 32 and electrical wires leading to the at least one longitudinally extending LED lamp or an array of LEDs, may be covered.

FIG. 5*b* is a bottom view of LED lamp housing 15 holding a longitudinally extending LED lamp 11. FIG. 5*c* is a bottom view of the LED lamp housing 15 holding an array of LEDs 13. It is to be understood that lamp housing 15 may be configured to hold a plurality of longitudinally extending LED lamps 11 or multiple array configurations of LEDs 13. For example, an array of LEDs 13 may comprise one or more LED strips disposed in parallel.

A modular LED lighting system of the present disclosure may comprise at least one LED lamp housing 15 configured to house and hold at least one longitudinally extending LED lamp 11 or an array of LEDs 13 mounted inside lamp housing 15 and electrically connect the at least one longitudinally extending LED lamp 11 or the array of LEDs 13 to a power source, not shown. LED lamp housing 15 may comprise two substantially parallel longitudinally extending sidewalls 12, each sidewall 12 being at least as long as the at least one longitudinally extending LED lamp 11 or the array of LEDs 13. Two substantially parallel end walls 20 may extend from edges of sidewalls 12 and form LED lamp housing 15 with a lower rectangular light opening 17. Each sidewall 12 may be configured to abut with a sidewall 12 of an adjacent LED lamp housing 15, in the modular LED lighting system of the present disclosure. Each of the end walls 20 may be configured to abut with an end wall 20 of an adjacent LED lamp housing 15, in the modular LED lighting system of the present disclosure. Each of the LED lamp housings 15, in the modular LED lighting system of the present disclosure, may be configured to adjoin with an adjacent LED lamp housing 15.

The modular LED lighting system of the present disclosure may be configured to be mounted on a ceiling suspension grid. For example, LED lamp housing 15 may comprise a top wall 14 extending from top edges of the sidewalls 12 and end walls 20. Top wall 14 may enclose a top of LED lamp housing 15 and light opening 17 may be an open bottom. The modular LED lighting system of the present disclosure may comprise at least one adjoining bar attached to top walls 14, of the adjacently adjoined LED lamp housings 15. Upon adjoining adjacent LED light housings 15, in modular LED lighting system of the present disclosure, each of the adjoined LED lamp housings have at least one sidewall 12 abutted with a sidewall 12 of an adjacent LED lamp housing 15 or at least one end wall 20 abutted with an end wall 20 of an adjacent LED lamp housing.

LED lamp housing 15 may further comprise a flange 16 extending outwardly from each of the sidewalls 12 and end walls 20 and about a portion of a perimeter of the light opening 17. Flange 16 may be disposed and configured for mounting the modular LED lighting system of the present disclosure on a ceiling suspension grid. The modular LED lighting system of the present disclosure may comprise at least two LED lamp housings 15 adjoined to one another, wherein each of the LED lamp housings 15 have a sidewall 12 abutted with a sidewall 12 of an adjacent LED lamp housing 15 or an end wall 20 abutted with an end wall 20 of an adjacent LED lamp housing 15. For example, LED lamp housing 15 may further comprise an abutting surface 18 extending upwardly from flange 16, which may be configured for abutting each of LED lamp housing 15 with an adjacent LED lamp housing 15, in the modular LED lighting system of the present disclosure. However, in at least one embodiment of the LED lamp housing of the present disclosure, the LED lamp housing is void of a flange and/or abutting surface.

FIG. 6*a* shows a lower perspective view of LED lamp housing 10 having a mechanically mounted lens 34. The modular LED lighting system of the present disclosure may have lens 34 mechanically mounted to or with LED lamp housing 10. For example, lens 34 may be comprised of a flexible light transmissible material, such as polymeric material, polycarbonate for example, and may be configured to bend into a concave configuration and snap into lamp housing 10 and be held with tabs 22, shown in FIGS. 1-5*a*.

Other and different lens configurations may be used with the modular LED lighting system of the present disclosure. For example, a lens may be configured to be magnetically attached to LED lamp housing 10. In at least one embodiment, a lens may have magnets or ferromagnetic materials and the LED lamp housing may have the other of magnets or ferromagnetic materials, wherein the magnets or ferromagnetic materials are configured and disposed to magnetically attach and hold lens to an LED lamp housing. For example, a lens may be substantially flat and may be configured to magnetically attach with or about a flange extending from the sidewalls or end walls. For example, as shown in FIG. 6*a*, lower right, lens 54 may be magnetically mounted about the light opening. Lens 54 may be substantially flat and may be configured to be held with LED lamp housing 10 with magnets 52. Magnets 52 may be disposed with LED lamp housing 10 or lens 54 and the other of LED lamp housing 10 or lens 54 may have a ferromagnetic material disposed to magnetically cooperate with magnets 54 and hold lens 54 to LED lamp housing 10.

FIGS. 6*b* and 6*c* show another embodiment of a mechanically mounted lens 35. The modular LED lighting system of the present disclosure may have lens 35 mechanically mounted to or with LED lamp housing 10. For example, lens 35 may be comprised of a flexible light transmissible material, such as polymeric material, polycarbonate for example. Lens 35 may have a convex portion 39 and outwardly and/or concave extending portions 37, extending about longitudinal edges of lens 35. Lens 35 may be configured to bend into a configuration and snap into lamp housing 10 and be held with tabs 22, cooperating with outwardly extending portions 37. LED lamp holders 44 are shown extending from top wall 14, in FIG. 6*c*. Electrical connector 42 is shown disposed and configured to electrically connect with an LED lamp or array of LEDs.

FIGS. 7 and 8 show lower and upper perspective views of a modular LED lighting system 40 of the present disclosure having adjacent LED lamp housings 10 with abutted end walls 20. Two or more LED lamp housings 10 may be adjacently adjoined to one another with their end walls 20 abutted. Sidewalls 12 may have a length l and end walls 20 may have a width w. Adjoining two LED lamp housings 10 together with their end walls 20 abutted provides modular LED lighting system 40 having a length of 2l and a width of w. In at least one embodiment of LED lighting system 40, the abutted and adjoined LED lamp housings 10 have an overall length of about 4 feet and a width of about 1 foot. LED lighting system 40 may have two, three, or any plurality of lamp housings 10 arranged in a variety of configurations.

A flange 16 may extend outwardly from each of the longitudinally extending sidewalls 12 and end walls 20 and abutting surface 18 may extend upwardly from flange 16. The abutted end walls 20, of each adjoined LED lamp housing 10, may have their adjacent abutting surfaces 18 completely, or substantially completely abutted or in contact with one another.

LED lamp housings 10 have top wall 14 extending from top edges of sidewalls 12 and top edges of the end walls 20. Top wall 14 may enclose a top of LED lamp housing 10 and have fastening sites 24, shown in FIGS. 1-4. Modular LED lighting system 40 may comprise one or more adjoining bars 36. Adjoining bars 36 extend between adjacent LED lamp housings 10 and are attached to the top walls 14 of adjacent lamp housings 10, at fastening sites 24. The adjoining bars 36 adjoin adjacent LED lamp housings 10, wherein each of the at least two adjoined LED lamp housings 10 have an end wall 20 abutted with an end wall 20 of an adjacently adjoined LED lamp housing 10. Adjoining bars 36 may be configured for mounting modular LED lighting system 40 to a portion of a structure. Adjacently adjoined LED lamp housings 10 may be in electrical communication with one another by way of electrical connection 19. Modular LED lighting system 40 may be configured to be mounted on a ceiling suspension grid.

FIGS. 9 and 10 show lower and upper perspective views of modular LED lighting system 50 having adjacent LED lamp housings 10 with abutted sidewalls 12. Two or more LED lamp housings 10 may be adjacently adjoined to one another with their sidewalls 12 abutted. Sidewalls 12 may have a length l and end walls 20 may have a width w. Adjoining two LED lamp housings 10 together with their sidewalls 12 abutted provides modular LED lighting system 50 having a length of l and a width of 2w. In at least one embodiment of LED lighting system 50, the abutted and adjoined LED lamp housings 10 have an overall length of about 2 feet and a width of about 2 feet. LED lighting system 50 may have two, three, or any plurality of lamp housings 10 arranged in a variety of configurations.

A flange 16 may extend outwardly from each longitudinally extending sidewall 12 and/or end walls 20 and abutting surface 18 may extend upwardly from flange 16. The abutted sidewalls 12, of each adjoined LED lamp housing 10, may have their adjacent abutting surfaces 18 completely, or substantially completely abutted or in contact with one another.

LED lamp housings 10 have top wall 14 extending from top edges of sidewalls 12 and top edges of the end walls 20. Top wall 14 may enclose a top of LED lamp housing 10 and have fastening sites 24, shown in FIGS. 1-4. Modular LED lighting system 50 may comprise one or more adjoining bars 38. Adjoining bars 38 extend between each of adjacent LED lamp housings 10 and are attached to the top walls 14 of adjacent lamp housings 10, at fastening sites 24. The adjoining bars 38 adjoin adjacent LED lamp housings 10, wherein each of the at least two adjoined LED lamp housings 10 have a sidewall 12 abutted with a sidewall 12 of an adjacently adjoined LED lamp housing 10. Adjoining bars 38 may be configured for mounting modular LED lighting system 50 to a portion of a structure. Modular LED lighting system 50 may be configured to be mounted on a ceiling suspension grid. Adjacently adjoined LED lamp housings 10 may be in electrical communication with one another by way of electrical connection 19.

FIGS. 11 and 12 show lower and upper perspective views of modular LED lighting system 60 having a plurality of adjacent LED lamp housings 10 with abutted sidewalls 12. Three, four, or more LED lamp housings 10 may be adjacently adjoined to one another with their sidewalls 12 abutted. Sidewalls 12 may have a length l and end walls 20 may have a width w. Adjoining four LED lamp housings 10 together with their sidewalls 12 abutted provides modular LED lighting system 60 having a length of l and a width of 4w. In at least one embodiment of LED lighting system 60, the abutted and adjoined LED lamp housings 10 have an overall length of about 2 feet and a width of about 4 foot.

A flange 16 may extend outwardly from at least a portion of each longitudinally extending sidewall 12 and end wall 20 and abutting surface 18 may extend upwardly from flange 16. The abutted sidewalls 12, of each adjacently adjoined LED lamp housing 10, may have their adjacent abutting surfaces 18 completely, or substantially completely abutted or in contact with one another.

LED lamp housings 10 have top wall 14 extending from top edges of sidewalls 12 and top edges of the end walls 20. Top wall 14 may enclose a top of LED lamp housing 10 and have fastening sites 24, shown in FIGS. 1-4. Modular LED lighting system 60 may comprise one or more adjoining bars 39. Adjoining bars 39 extend between LED lamp housings 10 and are attached to the top walls 14 of lamp housings 10, at fastening sites 24. The adjoining bars 39 adjoin LED lamp housings 10, wherein each of the adjoined LED lamp housings 10 have a sidewall 12 abutted with a sidewall 12 of an adjacently adjoined LED lamp housing 10. Adjoining bars 39 may be configured for mounting or hanging modular LED lighting system 60 with a portion of a structure. Modular LED lighting system 60 may be configured to be mounted on a ceiling suspension grid.

The presently disclosed modular LED lighting system may be configured to provide at least two linear LED sources and may be configured to connect to the branch circuit using a luminaire disconnect and may have a junction box covering the connection point which may be mounted to a wall of a LED lamp housing. The presently disclosed modular LED lighting system may be configured to be mounted with a ceiling grid or conventionally mounted with any number of mounting means including, but not limited to, S-Hook chain hung from an adjoining bar or surface mounted to a ceiling surface.

The invention claimed is:

1. A modular LED lighting system comprising:

at least one LED lamp housing configured to house and hold at least one longitudinally extending LED lamp or an array of LEDs mounted inside the lamp housing and electrically connect the at least one longitudinally extending LED lamp or the array of LEDs to a power source;

the LED lamp housing comprises:

two substantially parallel longitudinally extending sidewalls, each sidewall being at least as long as the at least one longitudinally extending LED lamp or the array of LEDs;

two substantially parallel end walls, each end wall extending from edges of the sidewalls and forming an LED lamp housing with a rectangular bottom light opening;

each of the sidewalls and each of the end walls comprising a flange extending outwardly from a perimeter of the light opening, the flange being configured for mounting the modular LED lamp on a ceiling suspension grid; and an abutting surface extending upwardly from the flange and being configured for abutting each of the at least one LED lamp housings with an adjacent LED lamp housing, in the modular LED lighting system.

2. The modular LED lighting system of claim 1 comprising at least two LED lamp housings adjacently adjoined to one another, each adjacently adjoined LED lamp housing having a sidewall abutted with a sidewall of the adjacent LED lamp housing or an end wall abutted with an end wall of the adjacent LED lamp housing.

3. The modular LED lighting system of claim 2, wherein each of the at least one LED lamp housings comprise a top wall extending from top edges of the sidewalls and top edges of the end walls and enclosing a top of the LED lamp housing.

4. The modular LED lighting system of claim 3 comprising at least one adjoining bar extending between each of the at least two adjoined LED lamp housings, each of the least one adjoining bars are attached to the top walls of the adjoined LED lamp housings.

5. The modular LED lighting system of claim 2, wherein each of the at least one LED lamp housings are in electrical communication with an adjacently adjoined LED lamp housing.

6. The modular LED lighting system of claim 1 further comprising a lens, wherein the lens covers at least a portion of the light opening.

7. The modular LED lighting system of claim 6, wherein the lens is substantially flat and is configured to be magnetically held with the LED lamp housing.

8. The modular LED lighting system of claim 6, wherein the lens is semi-cylindrical and is configured to be mechanically held with the LED lamp housing.

9. A modular LED lighting system comprising:

at least one LED lamp housing, wherein the at least one LED lamp housing is configured to house and hold at least one longitudinally extending LED lamp or an array of LEDs mounted inside the lamp housing and electrically connect the at least one longitudinally extending LED lamp or the array of LEDs to a power source;

the LED lamp housing comprises:

two substantially parallel longitudinally extending sidewalls, each sidewall being at least as long as the at least one longitudinally extending LED lamp or the array of LEDs;

two substantially parallel end walls, each end wall extending from edges of the sidewalls and forming an LED lamp housing with a rectangular lower light opening;

each of the sidewalls are configured to abut with a sidewall of an adjacent LED lamp housing in the modular LED lighting system;

each of the end walls are configured to abut with an end wall of an adjacent LED lamp housing in the modular LED lighting system; and each of the at least one LED lamp housings in the modular LED lighting system being configured to adjoin with an adjacent LED lamp housing; and wherein each of the at least one LED lamp housings further comprise a flange extending outwardly from each of the sidewalls and end walls and about a perimeter of the light opening, the flange being configured and disposed for mounting the modular LED lighting system on a ceiling suspension grid.

10. The modular LED lighting system of claim 9 comprising at least two LED lamp housings adjoined to one another, wherein each of the LED lamp housings have a sidewall abutted with a sidewall of an adjacent LED lamp housing or an end wall abutted with an end wall of an adjacent LED lamp housing.

11. The modular LED lighting system of claim 10, wherein each of the at least one LED lamp housings comprise a top wall extending from top edges of the sidewalls and top edges of the end walls, the top wall enclosing a top of the LED lamp housing, the rectangular light opening being an open bottom.

12. The modular LED lighting system of claim 11 comprising at least one adjoining bar adjacently adjoining the at least two adjoined LED lamp housings, wherein each of the at least two adjacently adjoined LED lamp housings have a sidewall abutted with a sidewall of an adjacent LED lamp housing or an end wall abutted with an end wall of an adjacent LED lamp housing and each of the least one adjoining bars are attached to the top walls of the adjacently adjoined LED lamp housings.

13. The modular LED lighting system of claim 12 wherein the at least one adjoining bar is configured for mounting the modular LED lamp to a portion of a structure.

14. The modular LED lighting system of claim 10, wherein each of the at least one LED lamp housings are in electrical communication with an adjacently adjoined LED lamp housing.

15. The modular LED lighting system of claim 9 further comprising an abutting surface extending upwardly from the flange and being configured for abutting each of the at least one LED lamp housings with an adjacent LED lamp housing in the modular LED lighting system.

16. The modular LED lighting system of claim 9 further comprising a lens, wherein the lens covers at least a portion of the light opening.

17. The modular LED lighting system of claim 16, wherein the lens is substantially flat or semi-cylindrical.

18. The modular LED lighting system of claim 16, wherein the lens is configured to be magnetically or mechanically held to or with the LED lamp housing.

* * * * *